US007645018B2

(12) United States Patent
Ikushima

(10) Patent No.: US 7,645,018 B2
(45) Date of Patent: Jan. 12, 2010

(54) METHOD OF ADJUSTING A LIQUID DROPLET, METHOD OF DISCHARGING THE LIQUID DROPLET AND APPARATUS THEREFOR

(75) Inventor: Kazumasa Ikushima, Mitaka (JP)

(73) Assignee: Musashi Engineering, Inc., Tokyo (JP)

( * ) Notice: Subject to any disclaimer, the term of this patent is extended or adjusted under 35 U.S.C. 154(b) by 0 days.

(21) Appl. No.: 10/565,504

(22) PCT Filed: Jul. 21, 2004

(86) PCT No.: PCT/JP2004/010343

§ 371 (c)(1),
(2), (4) Date: Dec. 21, 2006

(87) PCT Pub. No.: WO2005/009630

PCT Pub. Date: Feb. 3, 2005

(65) Prior Publication Data

US 2007/0188531 A1 Aug. 16, 2007

(30) Foreign Application Priority Data

Jul. 25, 2003 (JP) ..... 2003-280439

(51) Int. Cl.
*B41J 2/015* (2006.01)

(52) U.S. Cl. ..... 347/20; 347/54; 347/9

(58) Field of Classification Search ..... 347/9, 347/20, 54, 47, 10
See application file for complete search history.

(56) References Cited

U.S. PATENT DOCUMENTS 4,990,058 A * 2/1991 Eslinger ..... 417/46
5,343,769 A * 9/1994 Suovaniemi et al. ..... 73/864.18
6,230,606 B1 * 5/2001 Sato ..... 91/361
6,283,946 B1 * 9/2001 Fischer ..... 604/218

(Continued)

FOREIGN PATENT DOCUMENTS

FI WO 91/16977 * 11/1991

(Continued)

OTHER PUBLICATIONS

Supplementary European Search Report dated Sep. 3, 2008, issued in corresponding European patent application No. 04770853.

*Primary Examiner*—Matthew Luu
*Assistant Examiner*—Henok Legesse
(74) *Attorney, Agent, or Firm*—Westerman, Hattori, Daniels & Adrian, LLP

(57) ABSTRACT

A method and an apparatus of adjusting a discharge quantity of a liquid droplet with accuracy. When a plunger moves forward and stops sliding while closely contacting with an inner wall face of a tube, a discharge quantity of the liquid droplet discharged from a discharge port communicating with the tube is adjusted. A moving speed of the plunger is adjusted such that the liquid droplet discharged from the discharge port becomes constant at every discharge. The apparatus for discharging a liquid material, has a tube, a plunger sliding while closely contacting with an inner wall face of the tube, a discharge port communicating with the tube and discharging the liquid material so as to be scattered, and a control means controlling an operation of the plunger. The control means controls a moving speed of the plunger moving forward from start of deceleration to stop.

11 Claims, 3 Drawing Sheets

U.S. PATENT DOCUMENTS

| | | | | |
|---|---|---|---|---|
| 7,021,191 | B2 * | 4/2006 | Moler et al. | 91/393 |
| 2001/0016358 | A1 * | 8/2001 | Osawa et al. | 436/180 |
| 2005/0061391 | A1 | 3/2005 | Ikushima | |
| 2005/0231553 | A1 * | 10/2005 | Horsnell et al. | 347/47 |
| 2006/0144331 | A1 * | 7/2006 | Hanafusa et al. | 118/712 |

FOREIGN PATENT DOCUMENTS

| | | | |
|---|---|---|---|
| JP | 57-51671 | | 3/1982 |
| JP | 10-118547 | | 5/1998 |
| JP | 10-314640 | | 12/1998 |
| JP | 10-341073 | | 12/1998 |
| JP | 2003-126750 | A | 5/2003 |
| JP | 2003126750 | * | 5/2003 |
| JP | 2003-190871 | | 7/2003 |
| WO | 91/16977 | A1 | 11/1991 |

* cited by examiner

METHOD OF ADJUSTING A LIQUID DROPLET, METHOD OF DISCHARGING THE LIQUID DROPLET AND APPARATUS THEREFOR

BACKGROUND OF THE INVENTION

1. Field of the Invention

The present invention is one disclosing a method of adjusting a liquid droplet repeatedly discharged in order to discharge it as the liquid droplet of a shape uniform at every discharge or a quantity of good accuracy and a method of discharging the droplet, and an apparatus therefor.

2. Description of the Related Art

In prior arts in which the liquid droplet is delivered by the fact that a plunger closely slides along an inner face of a tubular member, there is one in which the plunger whose tip face closely contacts with a liquid material is forwardly advanced at high speed and the liquid material is discharged by applying an inertial force to the liquid material by subsequently abruptly stopping a means for driving the plunger (for example, refer to Japanese Patent Application Number 2002-301239). Further, there is one in which the plunger is provided in a liquid feed passage communicating a nozzle discharging the liquid material with a storage part storing the liquid material (for example, refer to JP-A-2003-126750 Gazette).

The above prior art references disclosed a technique for separating the liquid material from the nozzle before the liquid material is adhered to a body, such as a work, to be coated and a technique effective for delivering one liquid material to discharge, but have not been ones disclosing a method for improving a quantity accuracy at every time when the liquid droplet is repeatedly discharged. In the prior arts, there are the fact that two or more liquid droplets are discharged from the nozzle in one plunger operation for discharging the liquid material and the fact that no liquid droplet is discharged, so that a further improvement in the discharge quantity accuracy at every discharge has been desired.

SUMMARY OF THE INVENTION

Whereupon, it is an object of the invention to solve the above disadvantages possessed by the prior arts and to provide a method of adjusting a discharge quantity for discharging a liquid droplet repeatedly discharged as the liquid droplet of a quantity having a good accuracy and a method of discharging it, and an apparatus therefor.

In order to solve the above problems, according to a first aspect of the invention, there is provided a method of adjusting a liquid droplet quantity, in which, by a forward movement and a forward stopping of a plunger sliding while closely contacting with an inner wall face of a tube, a discharge quantity of the liquid droplet discharged from a discharge port communicating with the tube is adjusted, characterized in that a moving speed of the plunger moving forward from start of deceleration to stop is adjusted such that the liquid droplet discharged from the discharge port becomes constant at every discharge. According to a second aspect of the invention, there is provided a method of discharging a liquid droplet, characterized in that the liquid droplet is discharged by controlling an operation of the plunger to a moving speed adjusted by the adjusting method of the first aspect. According to a third aspect of the invention, there is provided a method of discharging a liquid droplet, characterized by coating the liquid droplet discharged by the method of the second aspect onto a work.

Further, according to a fourth aspect of the invention, there is provided a method of forming a liquid droplet, in which a liquid material discharged from a nozzle tip is formed into the liquid droplet by a forward movement of a plunger sliding while closely contacting with an inner wall face of a tube, characterized in that a uniform liquid droplet is formed by controlling a speed of the plunger moving forward from start of deceleration to stop.

According to a fifth aspect of the invention, there is provided an apparatus for discharging a liquid material, which possesses a tube, a plunger sliding while closely contacting with an inner wall face of the tube, a discharge port communicating with the tube and discharging the liquid material so as to be delivered, and a control means controlling an operation of the plunger, characterized in that the control means controls a moving speed of the plunger moving forward from start of deceleration to stop. According to a sixth aspect of the invention, there is provided an apparatus for discharging a liquid material of the fifth aspect, characterized by having an indication means (input means) indicating the moving speed of the plunger moving forward from start of deceleration to stop to the control means. According to a seventh aspect of the invention, there is provided an apparatus for discharging a liquid material of the sixth aspect, characterized in that the control means controls the operation of the plunger on the basis of data concerning the moving speed of the plunger moving forward from start of deceleration to stop, which has been indicated (inputted) by the indication means (input means).

Since a force dividing the liquid material discharged from a nozzle can be controlled by controlling the moving speed of the plunger moving forward from start of deceleration to stop, the liquid droplet can be surely separated from a discharge port of a nozzle tip, so that there is no case where the liquid droplet is discharged from the nozzle tip while being divided into two or more liquid droplets. Further, there is also no case where the liquid droplet is not discharged, so that a uniform liquid droplet can be formed and a discharge quantity accuracy at every discharge is improved.

DETAILED DESCRIPTION OF THE INVENTION

A quantity of the liquid droplet discharged from a nozzle tip is determined by a forward movement amount of the plunger which closely slides along a tube inner wall face and thereby presses the liquid material.

Figure 1A:
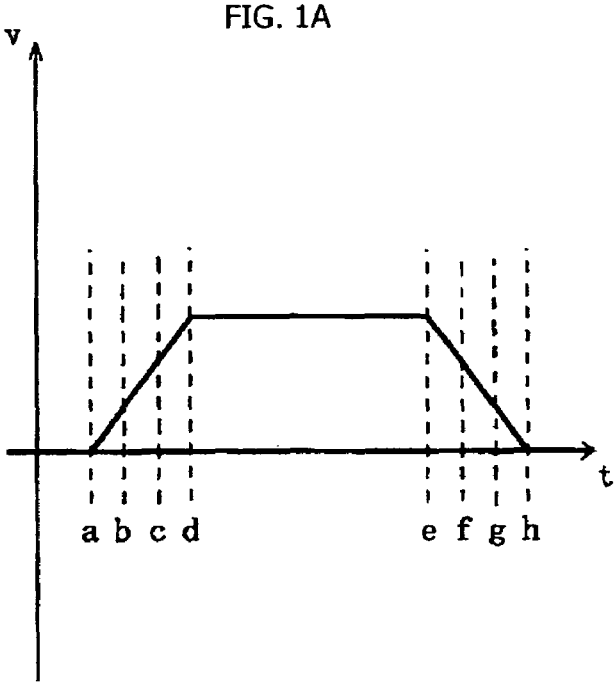
FIG. 1A is a speed change diagram for explaining an operation of a plunger.
Figure 1B:
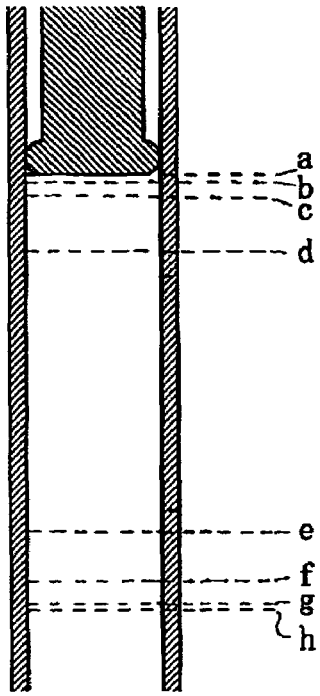
FIG. 1B is a position change diagram for the same.
Figure 2A:
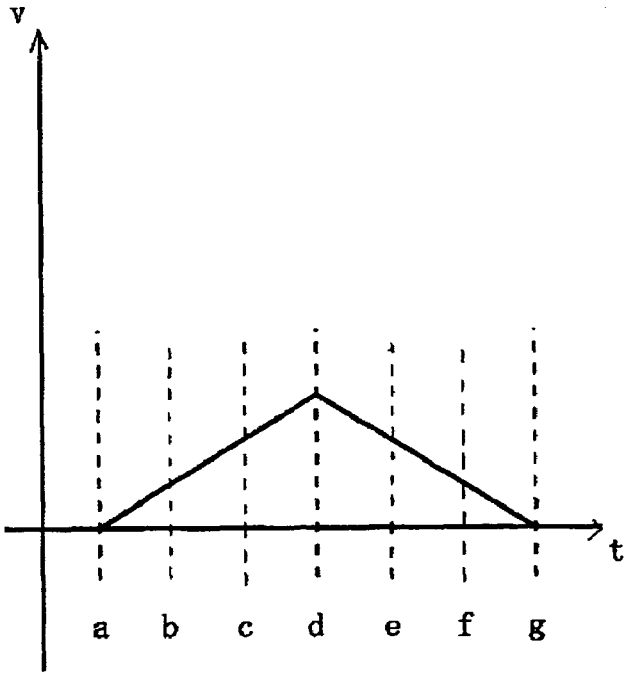
FIG. 2A is a speed change diagram for explaining other operation of the plunger.
Figure 2B:
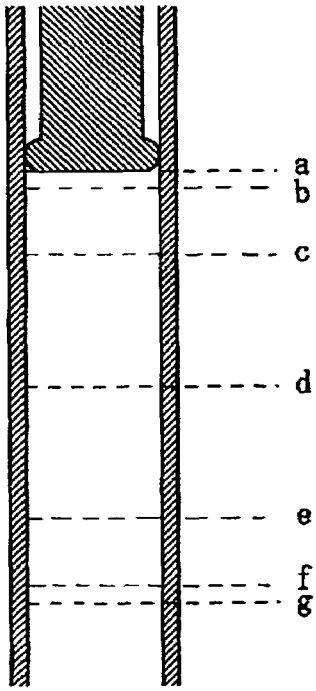
FIG. 2B is a position change diagram for the same.

During a plunger movement process when the plunger presses the liquid material in the tube to discharge the liquid droplet from the nozzle tip, i.e., during a process in which, after the stopped plunger has started its forward movement and accelerated to keep a constant speed, the plunger is moved by a regulated amount by the fact that the plunger is stopped by being decelerated (from a to h in FIGS. 1A and 1B), or during a process in which the plunger is moved by a regulated amount by the fact that the plunger is stopped by being decelerated by the fact that the stopped plunger has started its forward movement and accelerated but not kept the constant speed (from a to g in FIGS. 2A and 2B), it is possible to control the inertial force given to the liquid material when the liquid material discharged from the nozzle tip is divided into the liquid material remaining in a nozzle side and the liquid droplet delivered from the nozzle, so that the division can be smoothly performed.

Further, the liquid droplet smoothly divided by adjusting a deceleration degree is small in disturbance of a liquid droplet shape at every discharge also in the repeated discharge, and further a position of the division is also stable, so that the discharge quantity accuracy is good as well.

Embodiment 1

Embodiments of the invention are explained on the basis of the drawings, but the invention is not limited to the embodiments.

Figures 3A, 3B:
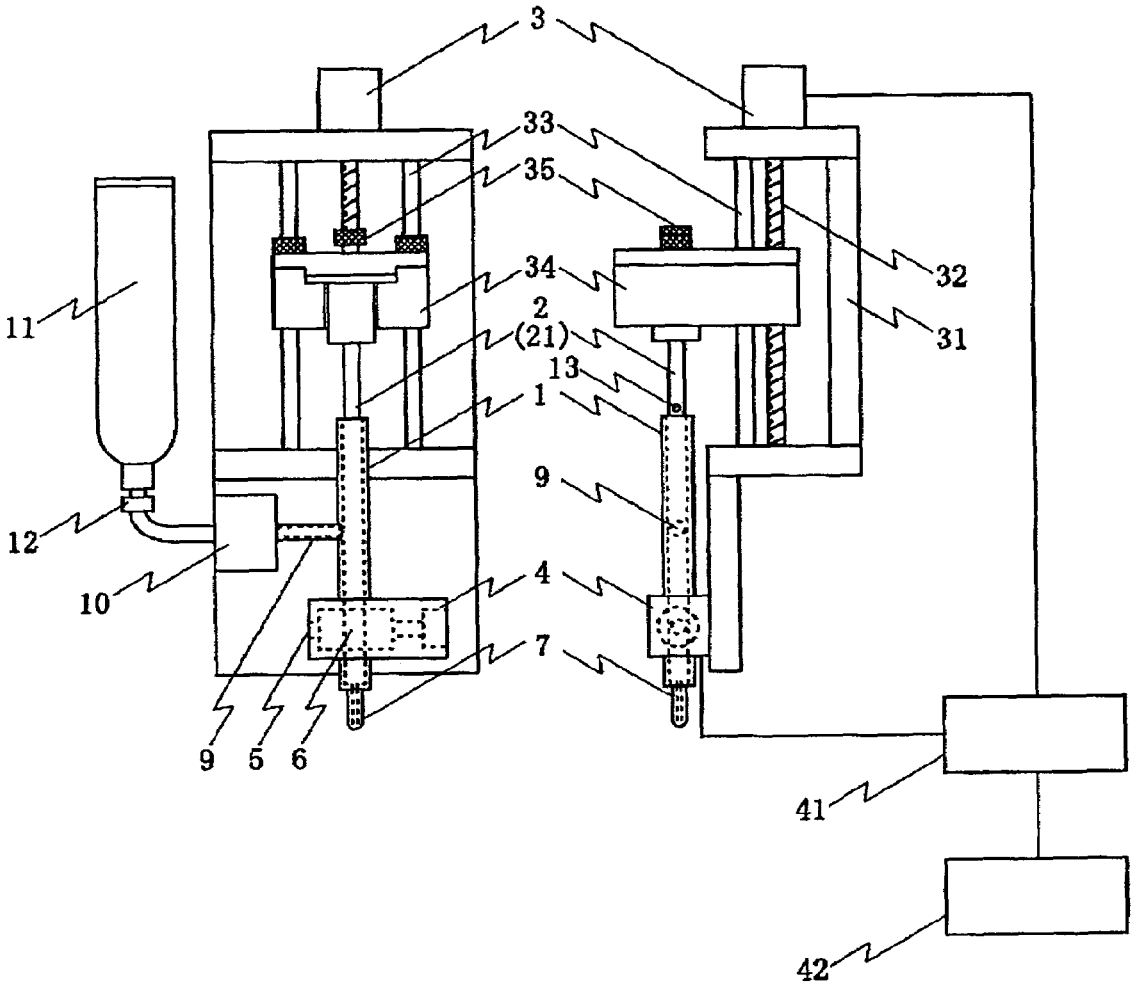
FIG. 3A is a front view showing the whole of a liquid material discharging apparatus.
FIG. 3B is a side view showing the same.

As shown in FIGS. 3A and 3B, it comprises a frame body, a discharge part and a liquid material storage container, which are supported by the frame body, and a control part controlling a discharge state of the liquid material. A frame body 31 comprises a frame body supporting a guide rod 33 guiding a plunger supporting body 34 in a vertical direction and a screw shaft 32 which is rotated by a motor 3 provided in an upper part of the frame body 31 and which moves the plunger supporting body 34 in the vertical direction, and a lower frame body supporting a discharge valve 4 and a metering part 1 through a liquid material supplying valve 10 and the discharge valve 4.

Inside the metering part 1 formed by a tubular member and supported by the frame body 31, there is provided a plunger 2 which moves up and down under a state of closely contacting with an inner face of the metering part 1 by a vertical movement of the plunger supporting body 34. A discharge valve 4 is provided in a tip of the metering part 1, and a nozzle 7 is provided in the other end of the discharge valve 4. Here, it is constituted such that an inner diameter of a flow passage 6 provided in a valve body 5 of the discharge valve 4 is approximately equal to an inner diameter of the metering part 1, and the liquid material smoothly flows from the metering part 1 to the discharge valve 4 when the valve 4 is in its open position.

Incidentally, in this embodiment, for the discharge valve 4, there has been adopted a rotary valve taking two positions of an open position where the metering part 1 and the nozzle 7 are communicated and a closed position where both are not communicated, but there may be used a slide valve and a pinch valve if a diameter of the flow passage is equal to an inner diameter of the metering part 1.

A tube 9 communicating with the metering part 1 is provided in a center part outer wall of the metering part 1. The other end of the tube 9 communicates with a storage container 11, and the liquid material supplying valve 10 is provided between the tube 9 and the storage container 11. Here, the liquid material supplying valve 10 takes two positions of an open position where the metering part 1 and the storage container 11 are communicated and a closed position where the communication is closed. Further, the storage container 11 can be attachable or detachable to or from the apparatus by a storage container connector 12 provided between the liquid material supplying valve 10 and the storage container 11.

If the storage container 11 filled with the liquid material is connected to the storage container connector 12, the liquid material supplying valve 10 is made the open position, the storage container 11 and the metering part 1 are communicated and the plunger 2 is moved rearward, the liquid material in the storage container 11 flows into the metering part 1 through the liquid material supplying valve 10.

For the discharge of the liquid material, the liquid material supplying valve 10 is made the closed position, the discharge valve 4 is made the open position, and the plunger 2 is moved forward in compliance with a desired discharge quantity. Here, it is possible to calculate a forward movement amount of the plunger 2 by the desired discharge quantity and the inner diameter of the metering part 1. As to the forward movement operation of the plunger 2, the plunger 2 abruptly stops its movement by, after being abruptly accelerated, abruptly stopping the plunger driving means without the plunger 2 being butted against a valve seat, and the liquid material in the metering part 1 is discharged from the nozzle 7 tip by the inertial force given by the high speed movement and the abrupt stopping of the plunger 2. If the inertial force becomes large, the liquid material is delivered. Here, since the inner diameter of the metering part 1 and the inner diameter of the discharge valve 4 are approximately equal, a pressure loss is small, so that the force given to the liquid material can be effectively utilized to discharge the liquid material.

After the plunger 2 has been moved to its lowermost end, the discharge valve 4 is made the closed position, the liquid material supplying valve 10 is made the open position and thus the plunger 2 is moved rearward, thereby supplying the liquid material. At this time, it is also possible to promote an in flow of the liquid material to the metering part 1 by pressurizing the liquid material in the storage container 11 by connecting a pressurizing means to the storage container 11.

Like this, the discharge work is performed by suitably repeating the operation of sucking the liquid material to the metering part 1 from the storage container 11 and discharging the liquid material in the metering part 1 from the nozzle 7. By the way, since the liquid material stored in the metering part 1 can be discharged over several times until the liquid material in the metering part 1 becomes null, a quantity of the liquid material stored in the metering part 1 can be suitably determined by considering a workability such as a size of the work to be discharged.

In FIGS. 3A and 3B, 41 is a control unit which controls a rotation operation of the motor 3 and an operation of the discharge valve 4. 42 is an input means which inputs operations of the plunger 2 such as a position, a movement distance, a movement speed, an acceleration degree and a deceleration degree of the plunger 2, and parameters concerning an operation of the discharge valve 4.

As to a control of a discharge state of the liquid material in the above control part, the liquid droplet quantity discharged from the nozzle tip is determined by an amount of the forward movement of the plunger which slides closely to the inner wall surface of the tube to press the liquid material. Accordingly, during a plunger movement process when the plunger presses the liquid material in the tube to discharge the liquid droplet from the nozzle tip, i.e., during a process in which, after the stopped plunger has started its forward movement and accelerated to keep a constant speed, the plunger is moved by a regulated amount by the fact that the plunger is stopped by being decelerated (from a to h in FIGS. 1A and 1B), or during a process in which the plunger is moved by a regulated amount by the fact that the plunger is stopped by being decelerated by the fact that the stopped plunger has started its forward movement and accelerated but not kept the constant speed (from a to g in FIGS. 2A and 2B), it is possible to control the inertial force given to the liquid material when the liquid material discharged from the nozzle tip is divided into the liquid material remaining in a nozzle side and the liquid droplet delivered from the nozzle by controlling the deceleration degree of the plunger moving forward (from e to h in FIG. 1 and from d to g in FIG. 2), so that the division can be smoothly performed.

Further, the liquid droplet smoothly divided by adjusting the deceleration degree is small in the disturbance of its droplet shape in every discharge even in the repeated discharge, and further a position of the division is stable and the discharge quantity accuracy is good as well.

Embodiment 2

Figure 4:
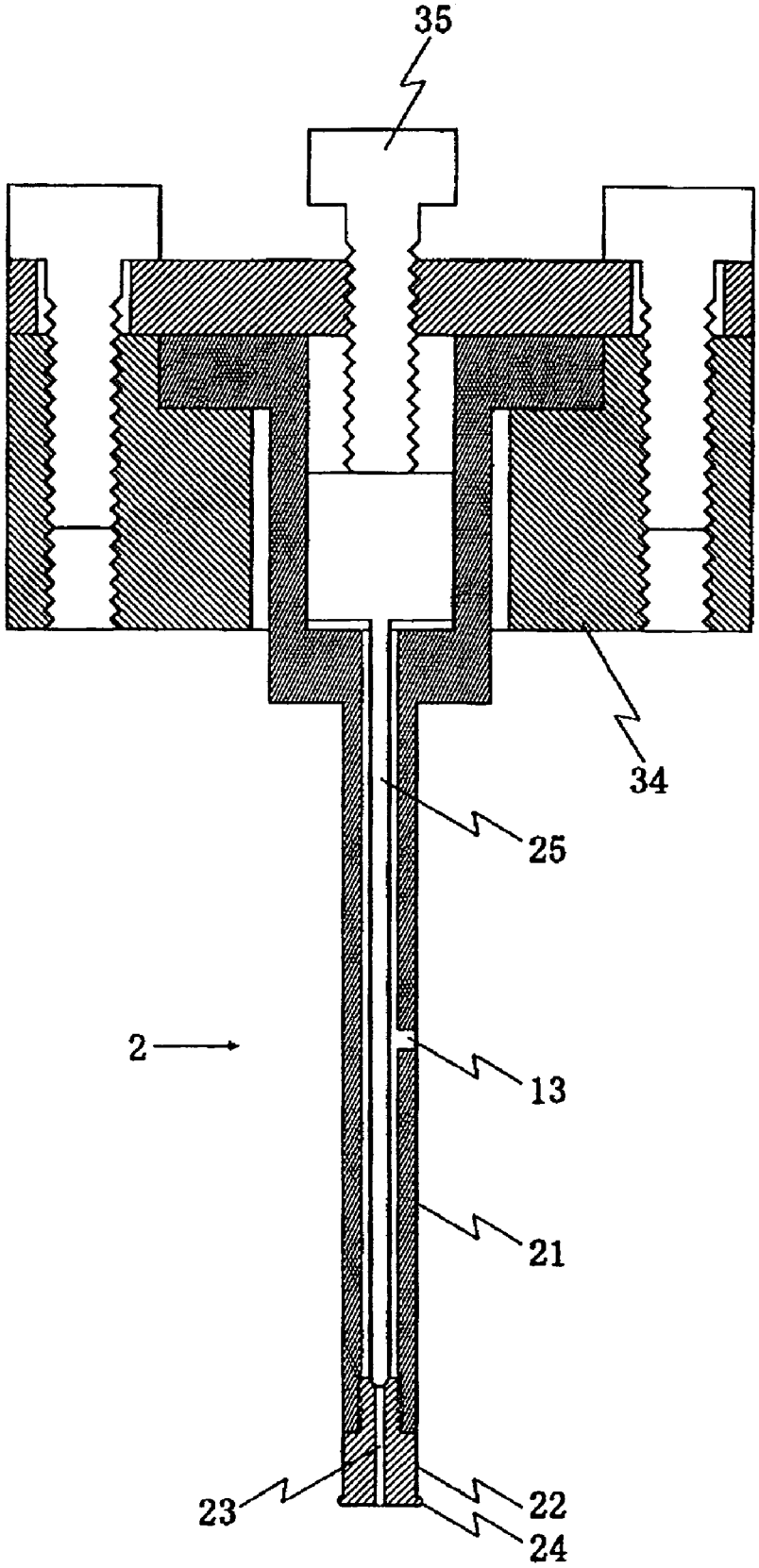
FIG. 4 is an enlarged view showing a main part of the liquid material discharging apparatus.

In the liquid droplet forming apparatus of the embodiment 1, since the air remains in a piping when filling the liquid material and thus there is a fear that a pressure response becomes deteriorated with a compression ability of the remaining air, a liquid droplet forming apparatus of the embodiment 2 is one in which an air bubble removing means shown in FIG. 4 is added to the plunger 2 in the liquid droplet forming apparatus of the embodiment 1.

The plunger 2 has a tubular part, and the tubular part comprises a plunger rod 21 having a communication hole 13 communicating with an outer wall face, a plunger head 22 which is mounted to a tip of the plunger rod 21 and which has in its center an air bubble removing hole 23 communicating with the tubular part of the plunger rod 21, and a valve rod 25 inserted into the tubular part of the plunger rod 21.

An upper part of the plunger rod 21 is formed in a cylinder part of a large diameter and, additionally, a flange part is formed in an upper end part and the plunger rod 21 is fixed to a plunger supporting body 34 by the flange part.

A large diameter part in an upper part of the valve rod 25 is slidably mounted to the cylinder part of the large diameter, and a fixing screw 35 meshed with the plunger supporting body 34 butts against the cylinder part of the large diameter. Normally, the valve rod 25 is pressurized in its one end by the fixing screw 35 and thus the other end of the valve rod 25 closely contacts with the plunger head 22, thereby closing the air bubble removing hole 23.

If the fixing screw 35 is loosened, since the valve rod 25 is movable in a length direction of the valve rod 25, the valve rod 25 and the plunger head 22 are spaced when the valve rod 25 butts against the fixing screw 35 to open the air bubble removing hole 23 provided in the plunger head 22, so that the air bubble removing hole 23 and the hole 13 of the plunger rod 21 are communicated through an interstice between the plunger rod 21 and the valve rod 25, thereby communicating with an outside.

Accordingly, by loosening the fixing screw 35, the plunger 22 is possible to communicate with the outside through the plunger rod 21 and the air bubble removing hole 23, and the air bubble is discharged from the plunger head 22 to the outside through the passage concerned.

An operation and a control of the liquid droplet forming apparatus of the above constitution are basically similar to the embodiment 1, but the air remains in the piping between the metering part 1 and the storage container 11 when the liquid material starts to be filled.

Whereupon, if the liquid material supplying valve 10 is made the closed position and the plunger 2 is moved forward under a state that a constraint of the valve rod 25 has been released by loosening the fixing screw 35, the valve rod 25 is moved rearward in the plunger rod 21 by being pressed by the air in the metering part 1 and, since the valve rod 25 is separated from the plunger head 22 and an inside of the metering part 1 forms an exhaust passage communicating with the outside through the air bubble removing hole 23, the interstice between the plunger rod 21 and the valve rod 25 and the hole 13 provided in the plunger rod 21, if the plunger rod 2 is additionally moved forward, the air in the metering part 1 is discharged to the outside through the exhaust passage. If the exhaust of a total quantity of the remaining air has been finished by additionally moving the plunger rod 2 forward, a tip part of the valve rod 25 is butted against the plunger head 22 by tightening the fixing screw 35 to close the air bubble removing hole 23, thereby finishing a air bubble removal by cutting the communication between the inside of the metering part 1 and the outside.

Incidentally, the above explanation has been made about the air bubble removal at a work starting time. However, even during the discharging work, in a case where the entry of the air bubble into the metering part 1 is recognized, an air bubble removing work is performed by speedily loosening the fixing screw 35, closing the discharge valve 4 and moving the plunger 2 forward, and, if the air bubble removal has been finished, the discharging work can be continued by tightening the fixing screw 35 and opening the discharge valve 4.

What is claimed is:

1. A method of discharging liquid droplets of a liquid material, comprising:

providing a liquid discharging apparatus comprising a metering tube having a columnar internal space formed substantially the same diameter, a plunger whose tip face closely contacts an inner wall surface of the metering tube, a storage container filled with the liquid material, a flow passage communicating the metering tube with the storage container, a liquid material supplying valve on the flow passage, a discharge valve disposed at a nozzle side distal end of the metering tube, and a nozzle in communication with the discharge valve;

supplying the metering tube with the liquid material by moving the plunger rearward to a first position while the liquid material supplying valve is in the open position and the discharge valve is in the closed position;

moving the plunger forward from the first position and stopping the plunger at a second position while the liquid material supplying valve is in the closed position and the discharge valve is in the open position, thereby discharging a first droplet from the nozzle; and moving the plunger forward from the second position and stopping the plunger at a third position while the liquid material supplying valve is in the closed position and the discharge valve is in the open position, thereby discharging a second droplet from the discharge port, wherein speed of the plunger from a start of a deceleration to a stop of the plunger is controlled during the steps of moving forward and stopping the plunger such that the first droplet and the second droplet are of the same quantity, without abruptly stopping the plunger, and wherein the liquid material supplied in the metering tube in a single supplying step is discharged from the discharge port in a plurality of steps of moving the plunger forward.

2. A method of discharging a liquid droplet of claim 1, wherein the plunger having an air bubble removing mechanism.

3. A method of discharging a liquid droplet, wherein the liquid droplet discharged by the method of the claim 1 or 2 is applied onto a work.

4. A method of discharging a liquid droplet of claim 1 or 2, wherein the plunger is moved by a motor and controlling moving speed of the plunger by controlling a rotation of operation of the motor.

5. A method of discharging a liquid droplet of claim 1 or 2, wherein the step of controlling moving speed of the plunger comprises the steps of:

a) starting and accelerating forward movement of the plunger;

b) keeping the forward movement of the plunger at a constant speed;

c) decelerating and stopping the plunger, wherein the plunger is moved by a regulated amount.

6. A method of discharging a liquid droplet of claim 1 or 2, wherein the step of controlling moving speed of the plunger comprises the steps of:

a) starting and accelerating forward movement of the plunger;

b) decelerating and stopping the plunger without keeping the forward movement at a constant speed, wherein the plunger is moved by a regulated amount.

7. An apparatus for discharging a liquid material, comprising:

a metering tube having a columnar internal space formed substantially the same diameter;

a plunger whose tip face closely contacts an inner wall surface of the metering tube;

a storage container filled with the liquid material;

a flow passage communicating the metering tube with the storage container;

a liquid material supplying valve on the flow passage;

a discharge valve disposed at a nozzle side distal end of the metering tube; and a nozzle in communication with the discharge valve; and a controller controlling a rearward movement process of the plunger to a first position while the liquid material supplying valve is in the open position and the discharge valve is in the closed position, and a forward movement process of the plunger from a first position to a second position to discharge a first droplet, and from the second position to a third position to discharge a second droplet, while the liquid material supplying valve is in the closed position and the discharge valve is in the open position, thereby the liquid material supplied in the metering tube in a single supplying step is discharged from the nozzle in a plurality of steps of moving the plunger forward, wherein the controller controls a moving speed of the plunger from a start of a deceleration to a stop of the plunger in the steps of moving forward and stopping the plunger such that the first droplet and the second droplet are of the same quantity, without abruptly stopping the plunger.

8. An apparatus for discharging a liquid material of claim 7, comprising an input device indicating the moving speed of the plunger moving forward from start of deceleration to stop to the controller.

9. An apparatus for discharging a liquid material of claim 8, wherein the controller controls the operation of the plunger on the basis of data concerning the moving speed of the plunger moving forward from start of deceleration to stop, which has been inputted by the input device.

10. An apparatus for discharging a liquid material of claim 7, 8, or 9, wherein the plunger having an air bubble removing mechanism.

11. A apparatus of discharging a liquid material of claim 7, 8, or 9, wherein the plunger is moved by a motor and the controller controls moving speed of the plunger by controlling a rotation of operation of the motor.

* * * * *